United States Patent [19]

Ludwigsen et al.

[11] Patent Number: 4,971,767

[45] Date of Patent: Nov. 20, 1990

[54] MANWAY COOLER—METHOD AND APPARATUS

[75] Inventors: Orville I. Ludwigsen, Prospect Heights; Carlos A. Cabrera, Northbrook, both of Ill.

[73] Assignee: UOP, Des Plaines, Ill.

[21] Appl. No.: 231,316

[22] Filed: Aug. 12, 1988

[51] Int. Cl.[5] ..... F27B 15/16; B21D 39/03

[52] U.S. Cl. ..... 422/144; 422/49; 422/146; 422/235; 165/104.16; 29/428

[58] Field of Search ..... 422/49, 144, 145, 146, 422/235; 165/104.16; 29/428

[56] References Cited

U.S. PATENT DOCUMENTS

| | | | |
|---|---|---|---|
| 2,492,948 | 1/1950 | Berger | 252/417 |
| 2,506,123 | 5/1950 | Watson | 422/214 |
| 2,515,156 | 7/1950 | Jahnig et al. | 422/139 |
| 2,596,748 | 5/1952 | Watson et al. | 252/417 |
| 2,819,951 | 1/1958 | Medlin et al. | 422/114 |
| 2,862,798 | 12/1958 | McKinney | 422/144 |
| 2,873,175 | 2/1959 | Owens | 422/110 |
| 2,970,117 | 1/1961 | Harper | 252/417 |
| 3,990,992 | 11/1976 | McKinney | 252/417 |
| 4,219,442 | 8/1980 | Vickers | 252/417 |
| 4,434,245 | 2/1984 | Lomas et al. | 502/2 |
| 4,439,533 | 3/1984 | Lomas et al. | 502/6 |
| 4,595,567 | 6/1986 | Hedrick | 422/146 |
| 4,710,357 | 12/1987 | Cetinkaya et al. | 422/144 |

*Primary Examiner*—Robert J. Warden
*Assistant Examiner*—Rebekah A. Griffith
*Attorney, Agent, or Firm*—Thomas K. McBride; John G. Tolomei

[57] ABSTRACT

Method of retrofitting catalyst coolers onto FCC regenerators and a cooler configuration specially suited for FCC regenerators uses a large manway or accessway commonly provided on the FCC regenerator to overcome the problems usually associated with finding a suitable space and clearance for the incorporation of a catalyst cooler. The catalyst cooler is added to the regenerator by removing the end cover from an existing manway on an FCC regenerator, extending the nozzle to provide a horizontal nozzle extension, attaching a vertical tube section of a catalyst cooler from the lower side of the nozzle extension and providing a new end closure at an opposite end of the nozzle extension. This method and the cooler apparatus minimizes the amount of welding and design work that must be done on the vessel and its associated piping when adding a catalyst cooler.

12 Claims, 3 Drawing Sheets

MANWAY COOLER—METHOD AND APPARATUS

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to the apparatus for performing the FCC process.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone.

Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively. These different configurations of FCC units include a stacked reactor/regenerator system where the FCC reactor is located directly above an FCC regenerator and a side-by-side FCC configuration where a reactor vessel is located to the side and above an FCC regenerator. Another form of reactor/regenerator configuration has a two-stage regeneration vessel with a reactor vessel again located to the side of the regenerator. In the two-stage regeneration vessel, there is usually an upper and lower regeneration chamber either or both of which may contain a dense fluidized bed of catalyst. In all of these configurations, regenerated catalyst flows from a regeneration vessel through a regenerator standpipe into a riser where it contacts an FCC charge stock. Expanding gases from the charge stock and fluidizing medium convey the catalyst up the riser and into a reactor vessel. Cyclone separators in the reactor divide the catalyst from reacted feed vapors which pass into an upper recovery line while the catalyst collects in the bottom of the reactor. A stripping vessel, located below the reactor vessel, receives spent catalyst from the reaction zone. Steam rises from the bottom of the stripper, countercurrent to the downward flow of catalyst, and removes sorbed hydrocarbons from the catalyst. Spent catalyst continues its downward movement from the stripper vessel through a reactor standpipe and into a dense fluidized catalyst bed contained within the regeneration vessel. Coke on the spent catalyst reacts with oxygen in air stream that ascends through the regeneration vessel and ultimately becomes regeneration gas. Again, cyclone separators at the top of the regenerator return catalyst particles to the dense bed and deliver a relatively catalyst-free regeneration gas to an overhead gas conduit.

Changes in regeneration technique, types of available feedstock, and higher throughput requirements have affected the way in which FCC units are operated. These operational changes have greatly diminished the utility and viability of many existing FCC arrangements. A particularly useful addition to the regeneration technique are means to remove heat from the regenerator. The major impetus for adopting heat removal techniques in the regenerator is the need to improve conversion of a wide variety of feedstocks.

Optimization of feedstock conversion ordinarily requires essentially complete removal of coke from the catalyst. This essentially complete removal of coke from catalyst is often referred to as complete regeneration. Complete regeneration produces a catalyst having less than 0.1 and preferably less than 0.05 weight percent coke. The application of the FCC process to crack heavy feedstocks produces greater amounts of coke. With the increased coke producing tendencies of these heavy or residual feeds, a complete regeneration of catalyst becomes more difficult due to the excessive heat evolution associated with additional coke combustion.

The increase in coke on spent catalyst results in a larger amount of coke being burnt in the regenerator per pound of catalyst circulated. Heat is removed from the regenerator in conventional FCC units in the flue gas and principally in the hot regenerated catalyst stream. An increase in the level of coke on spent catalyst will increase the temperature difference between the reactor and the regenerator, and the regenerated catalyst temperature overall. A reduction in the amount of catalyst circulated is, therefore, necessary in order to maintain the same reactor temperature. However, this lower catalyst circulation rate required by the higher temperature difference between the reactor and the regenerator will lower hydrocarbon conversion, making it necessary to operate with a higher reactor temperature in order to maintain conversion at the desired level. This will cause a change in yield structure which may or may not be desirable, depending on what products are required from the process. Also, there are limitations to the temperatures that can be tolerated by FCC catalyst without there being a substantial detrimental effect on catalyst activity. Generally, with commonly available modern FCC catalyst, temperatures of regenerated catalyst are usually maintained below 760° C. (1400° F.), since loss of activity would be very severe at about 760°-790° C. (1400°-1450° F.). If a relatively common reduced crude such as that derived from Light Arabian crude oil were charged to a conventional FCC unit, and operated at a temperature required for high conversion to lighter products, i.e., similar to that for a gas oil charge, the regenerator temperature would operate in the range of 870°-980° C. (1600°-1800° F.). This temperature would be too high a temperature for the catalyst, require very expensive materials of construction, and give an extremely low catalyst circulation rate. It is, therefore, accepted that when materials are processed that would give excessive regenerator temperatures, a means must be provided for removing heat from the regenerator, which enables a lower regenerator temperature, and a lower temperature difference between the reactor and the regenerator to be obtained.

A common prior art means for removing heat from a regenerator provides coolant filled coils within the regenerator which are in contact with the catalyst. For example, Medlin et al. U.S. Pat. No. 2,819,951, McKinney U.S. Pat. No. 3,990,992, and Vickers U.S. Pat. No. 4,219,442 disclose fluid catalytic cracking processes using dual zone regenerators with cooling coils positioned in the second zone. The prior art is also replete with disclosures of FCC processes which utilize dense or dilute phase regenerated fluid catalyst heat removal zones or heat exchangers, that are external to the regenerator vessel, to cool hot regenerated catalyst for return to the regenerator. Examples of such disclosures are as set forth in Harper U.S. Pat. No. 2,970,117; Owens U.S. Pat. No. 2,873,175; McKinney U.S. Pat. No. 2,862,798; Watson et al. U.S. Pat. No. 2,596,748; Jahnig et al. U.S. Pat. No. 2,515,156; Berger U.S. Pat. No. 2,492,948; Watson U.S. Pat. No. 2,506,123; and Lomas et al. U.S. Pat. No. 4,434,245. Another U.S. Pat. No. 4,439,533 issued to Lomas et al. shows an external heat removal zone in which catalyst is circulated between the heat removal zone and the regeneration vessel across a single passage that communicates the two zones.

External heat removal zones comprising catalyst coolers having a remote location from the regenerator vessel are widely accepted. This type of cooler has been found to have a high heat withdrawal capacity, operate reliably and provide few additional constraints on the start-up, shut-down and operation of the FCC system. Two types of remote catalyst coolers have found widespread use. One is a flow-through cooler where catalyst is taken from the regenerator vessel, added to one end of the catalyst cooler, passed through the cooler, recovered from an opposite end of the cooler and returned to the regeneration vessel. The other type of catalyst cooler is a backmix cooler in which a large diameter opening at an upper end of the cooler communicates with a catalyst bed within the regeneration zone. Air added at the bottom of the cooler fludizes and backmixes the catalyst so that hot catalyst is recirculated down the length of the cooler and circulated across the opening between the catalyst cooler and the regeneration vessel. Incorporating either type of catalyst cooler into the regenerator requires clearance for the space occupied by the cooler and adequate space for cooler maintenance which normally requires of the heat exchange tubes.

Thus, adding a remote catalyst cooler to a regenerator vessel requires a clear area around the vessel where the cooler may be added and maintained. Finding the space for locating either type of cooler poses additional design constraints. These constraints apply whether the regenerator vessel is newly designed or the regenerator vessel is one that has been in service (hereinafter referred to as an existing regenerator.)

Transfer of catalyst through the flow-through type cooler normally requires more space for catalyst transfer lines around the cooler. The backmix type cooler has the advantage of not requiring transfer lines but it does require a large opening in the regeneration vessel for communicating catalyst back and forth between the cooler and the regeneration vessel. Providing the opening for a backmix catalyst cooler requires that a large opening be cut into the shell of the regenerator vessel. Depending on the size of the catalyst cooler, the required opening in the regenerator vessel will usually exceed six feet and often be greater than eight feet in diameter. Providing a large opening of this type in an existing regenerator, especially after it is operated for a substantial period of time, should be avoided where possible in order to preserve the structural integrity of the vessel. In addition, a large amount of welding will be needed to install a nozzle about the opening to which the catalyst cooler can be attached and to reinforce the regenerator vessel for the increased stresses associated with the new opening. This reinforcement will usually consist of large metal pads that surround the new nozzle and are welded to the vessel shell.

In many cases, clearance problems also pose significant difficulties. Usually, the regenerator vessel is the lowermost vessel in the reactor regenerator combination. The remote catalyst cooler normally withdraws catalyst off of the dense bed in the regenerator. Therefore, little ground clearance is usually available for the cooler, since the regenerator vessel has a relatively low elevation and the regenerator dense bed is located at a relatively low location in the regenerator vessel. In addition to ground clearance problems, the resulting low elevation of the remote cooler also limits the amount of space that will be readily available for the cooler. Much of the structure for supporting the FCC unit and a large amount of piping associated with the FCC unit or other process units are located at relatively low elevations. Therefore all of this equipment and structure can limit the amount of space available for the cooler.

As a result, space constraints and mechanical considerations associated with the regenerator vessel make it difficult to install catalyst coolers on regenerator vessels. In particular, it would be highly desirable to add remote catalyst coolers to existing regenerator units in order to upgrade their operation for newer regeneration techniques, however, mechanical and structural limitations are the most severe on the existing vessels.

It is an object of this invention to facilitate the installation of remote catalyst coolers on regeneration vessels.

It is a further object of this invention to find a location for a remote catalyst cooler on a regeneration vessel that will readily provide clearance for the cooler and to provide an unrestricted catalyst flow to the catalyst cooler.

It is a further object of this invention to minimize the necessary structural changes to an existing regeneration vessel for the incorporation of the remote catalyst cooler.

It is a yet further object of this invention to provide a method for retrofitting a remote catalyst cooler on an existing regeneration vessel of an FCC unit.

BRIEF DESCRIPTION OF THE INVENTION

These and other objects are achieved by this invention which uses the accessway or manway commonly found on regeneration vessels as the opening by which catalyst is communicated to a remote catalyst cooler. Most regenerator vessels are provided with a large diameter manway or accessway for the installation of equipment. In attempting to find a suitable area about the outside of regenerator vessel where a remote catalyst cooler could be located, the location of the large regenerator manway or accessway was excluded from the available area due to the knowledge that this opening was needed for access into the vessel. It has now been discovered that by the use of a nozzle extension from this opening, it can still be used for vessel access while during operation, also providing an opening by which catalyst is communicated to a remote catalyst cooler. By discovering that the manway opening could also be used for this purpose, it was no longer necessary to cut a second large opening in the regenerator shell. Therefore this invention has the dual benefit of providing a location with adequate space for the addition of a catalyst cooler while enhancing or preserving the structural integrity of the vessel by avoiding the addition of any new openings on the vessel shell. Since clearance is needed around this access opening for maintaining the regenerator vessel, in particular, for the installation and removal of cyclones through this opening, the manway area readily provides the needed clearance. The use of this location will simplify the design of new regenerator vessels that incorporate catalyst coolers and, in many cases, will permit the installation of remote coolers on existing regenerator vessels.

Therefore, in one embodiment, this invention is an apparatus for regenerating coke-contaminated fluidized catalyst particles that has a regeneration vessel for maintaining a relatively dense fluidized bed of catalyst particles. A substantially horizontal nozzle in open communication with the regenerator vessel projects away from the regeneration vessel. The nozzle has an end closure at its end opposite the regeneration vessel. At least a portion of a principally vertical catalyst cooler depends from the nozzle. A plurality of heat exchange tubes are located inside the cooler and extend along its principal axis.

In another embodiment, this invention is a method of retrofitting a catalyst cooler on an existing regenerator vessel that has a nozzle forming an access opening for use when the vessel is not in operation. The nozzle has an end cover that occludes the opening when the vessel is not in operation and the method includes removing the end cover from the nozzle, extending the nozzle outwardly from the principal axis of the regenerator vessel with a nozzle extension. The catalyst cooler is attached to the nozzle extension and openly communicates with the nozzle extension. The catalyst cooler has a principally vertical orientation and a plurality of heat exchange tubes positioned in the cooler. The method includes providing the original enclosure or a new enclosure on the outermost portion of the nozzle extension.

Additional details, embodiments and objects of the invention are described in the following detailed description.

DETAILED DESCRIPTION OF THE INVENTION

The method of retrofitting a catalyst cooler to an existing FCC unit, as shown in this invention, the specific arrangement of catalyst cooler shown herein, can be applied to any FCC regenerator that has an accessway or manway of sufficient size to accommodate catalyst transfer between the cooler and the regenerator vessel. The following description shows the catalyst cooler added to a regenerator of a side-by-side reactor/regenerator configuration. However, the cooler arrangement and this retrofitting method can be used in any FCC unit having the above described accessway and adequate open space around the accessway.

Figure 1:
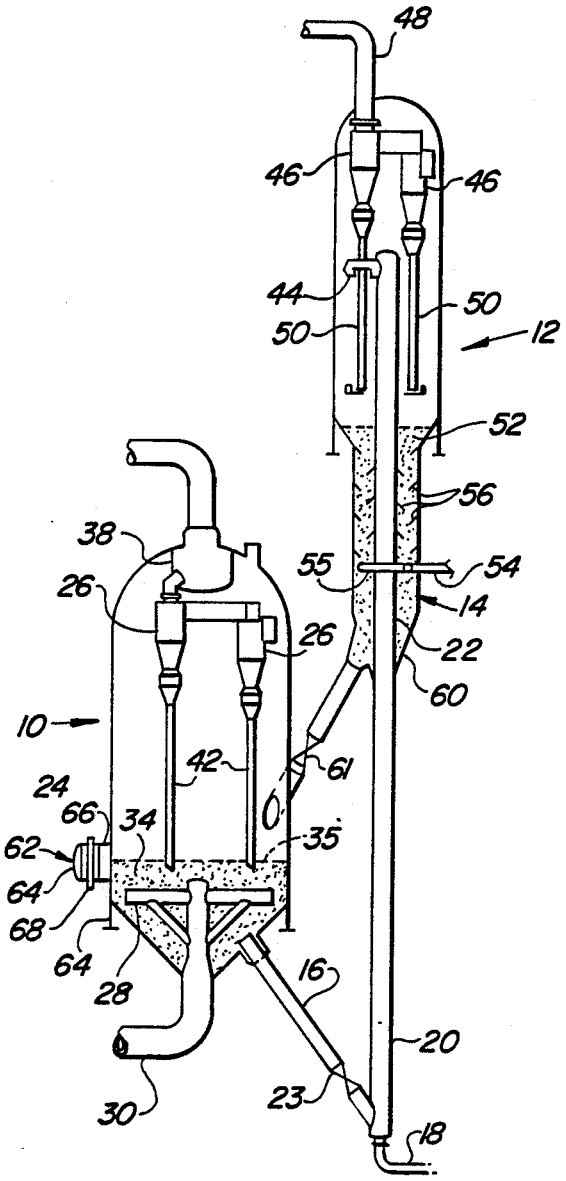
FIG. 1 shows a side-by-side reactor/regenerator configuration and is representative of the prior art.

Looking then at FIG. 1, the FCC arrangement has a regeneration vessel 10, a reactor 12, located to the side and above the regenerator, and a stripping vessel 14, located directly below the reactor.

A regenerated catalyst conduit 16 transfers catalyst from the regenerator through a control valve 23 and into a riser conduit 20 where it contacts hydrocarbon feed entering the riser through hydrocarbon feed conduit 18. Conduit 18 may also contain a fluidizing medium such as steam which is added with the feed. Expanding gases from the feed and fluidizing medium convey catalyst up the riser and into internal riser conduit 22. As the catalyst and feed pass up to the riser, the hydrocarbon feed cracks to lower boiling hydrocarbon products.

Riser 22 discharges the catalyst and hydrocarbon mixture through opening 44 to effect an initial separation of catalyst and hydrocarbon vapors. Outside openings 44, a majority of the hydrocarbon vapors continue to move upwardly into the inlet of cyclone separators 46 which effects a near complete removal of catalyst from the hydrocarbon vapors. Separated hydrocarbon vapors exit reactor 12 through an overhead conduit 48 while a dip leg conduits 50 return separated catalyst to a lower portion of the reactor vessel. Catalyst from riser outlets 44 and dip leg conduit 50 collects in a lower portion of the reactor forming a bed of catalyst 52. Bed 52 supplies catalyst to stripping vessel 14. Steam entering stripping vessel 14 through a conduit 54 is distributed by a ring 55 and rises countercurrent to a downward flow of catalyst through the stripping vessel thereby removing sorbed hydrocarbons from the catalyst which are ultimately recovered with the steam by cyclone separators 46. In order to facilitate hydrocarbon removal, a series of downwardly sloping baffles 56 are provided in the stripping vessel 14. A spent catalyst conduit 58 removes catalyst from a lower conical section 60 of stripping vessel 14. A control valve 61 regulates the flow of catalyst from conduit 58.

Regeneration gas, such as compressed air, enters regenerator 10 through a conduit 30. An air distributor 28 disperses air over the cross-section of regenerator 10 where it contacts spent catalyst in bed 34 having an upper bed level 35. Coke is removed from the catalyst by combustion with oxygen from distributor 28. Combustion by-products and unreacted air components rise upwardly along with entrained catalyst through the regenerator into the inlets of cyclones 26. Relatively catalyst-free gas collects in an internal chamber 38 which communicates with a gas conduit 40 for removing spent regeneration gas from the regenerator. Catalyst, separated by the cyclones drops from the separators through dip leg conduits 42 and returns to bed 34.

Regeneration vessel 10 will typically have a refractory lined metal shell 24 which is capable of withstanding temperatures within the regenerator in excess of 815° C. (1500° F.). This makes the regenerator vessel suitable for high operating temperatures. An accessway 62 is positioned at a lower section of shell 24. Looking at accessway 62 from the outside of the regenerator vessel, it is positioned a short distance above a support skirt 64 from which the regenerator is supported by a suitable structure. Looking at accessway 62 from the interior of the regenerator, it is positioned a short distance above distributor 28 and with at least a portion of its vertical dimension below the top of catalyst bed surface 35. Accessway 62 serves as both a manway for the movement of maintenance personnel in out of the regeneration vessel when the interior of the vessel, such as the refractory lining, or the equipment located therein needs servicing. Accessway 62 usually has a large diameter so that equipment such as cyclones 26 may be brought in and out of the vessel through the accessway. For this invention, it is usually preferred that the accessway have a diameter at least equal to the diameter of the cooler. Accessway 62 consists of an end cover 64 connected to a vessel nozzle 66 by a pair of flanges 68. Flanges 68 are of the usual bolted construction that allows the end cover 64 to be removed and reinstalled as necessary. Interior portions of the end cover, flanges and nozzle associated with accessway 62 are also internally refractory lined to withstand the high regenerator temperatures.

Figure 2:
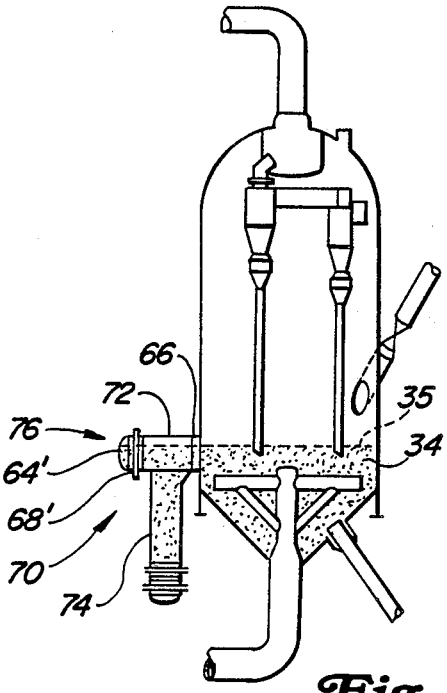
FIG. 2 shows a side-by-side reactor/regenerator with a catalyst cooler of this invention added to the side of the regeneator.

FIG. 2 shows a regenerator vessel of a side-by-side of FCC unit that is the same in all respects to the regenerator vessel shown in FIG. 2 except for the addition of a catalyst cooler 70. Catalyst cooler 70 was added to a regenerator shell 24 by removing the end cover 64 and the flanges 68 of accessway 62 from nozzle 66 and welding a nozzle extension 72 to the nozzle 66. Catalyst cooler 70 includes a tube section 74 that depends in a substantially vertical direction from nozzle extension 72. In most cases, the tube section of the cooler will have a vertical orientation, however, in order to avoid structural or other obstructions, the bottom of the tube section 74 may be swung outwardly from the regenerator centerline or to one side or the other of a plane passing through nozzle 72 and the regenerator centerline. However, in order for the cooler to function satisfactorily, the centerline of the tube section should be positioned with its principal axis as close to the vertical as possible. Therefore, the angle of the tube section from vertical should normally not exceed 20°. Tube section 74 is supported from the cooler nozzle which has a total length made up of nozzle extension 72 and axis or manway nozzle 66. Axis nozzle 66, in almost all cases, extends horizontally outward from shell section 24. Therefore, the cooler nozzle will have at least the axis nozzle portion 66 extending in the horizontal direction. Typically, nozzle extension 72 will also extend in a horizontal direction from axis nozzle 66. A substantially horizontal orientation for nozzle extension 72 is preferred to maximize the effective open area of the nozzle for facilitating the movement of equipment in and out of the vessel during vessel maintenance and transferring catalyst between the catalyst cooler and the regenerator during operation. For the purpose of the application substantially horizontal means an angle of 10° or less from the horizontal. Cooler 70 also has a end closure 76 made up of an end cover 64' attached to nozzles extension 72 by a pair of flanges 68'.

Where possible equipment expense may be saved by reusing end cover 64 and flanges 68, which are removed from accessway 62 to provide end cover 64' and flanges 68'. The cooler 70 may be either a flow-through or backmix type cooler. If the method and apparatus of this invention uses a flow-through type cooler, a separate conduit must be provided at the bottom of tube section 74 to either supply or withdraw catalyst to the cooler section. Depending upon the arrangement catalyst may be either withdrawn or supplied through nozzle extension 72 when using a flow-through type cooler with this invention. It is also possible to extend an upflow catalyst cooler from an upper section of nozzle 72. In such an arrangement, the cooler is positioned vertically above the nozzle and catalyst flows from the bottom of the cooler out of the top of the cooler.

However, this invention provides its greatest benefits when used with a backmix type cooler. A backmix type cooler reduces the temperature of the catalyst in the regeneration zone by circulating catalyst across nozzle extension 72 and access nozzle 66. The large diameter of the accessway or manway provides a large open area that allows circulation of catalyst in a lower portion of the nozzle and the transfer of aeration gas along an upper surface of the nozzles. This large open area enhances the operation of the cooler by promoting a free circulation of catalyst between the regenerator and the cooler. It is known that backmixing can be obtained within the heat exchanger at reasonable superficial gas velocities which circulate the catalyst within the cooler and across the access nozzle. In a backmix operation, the addition of fluidizing gas or air affects the heat transfer coefficient directly by changing the superficial velocity over the heat exchanged surfaces and indirectly influencing the extent of mass flow of catalyst through the cooler. The higher mass flow will also result in higher heat exchanger duty because the average catalyst temperature in the cooler will be higher which provides a higher temperature difference ($\Delta T$) to which the amount of heat transfer is directly proportional. Additional details on the operation of a backmix cooling zone can be found in U.S. Pat. No. 4,439,533. The details of which are herein incorporated by reference.

Figure 3:
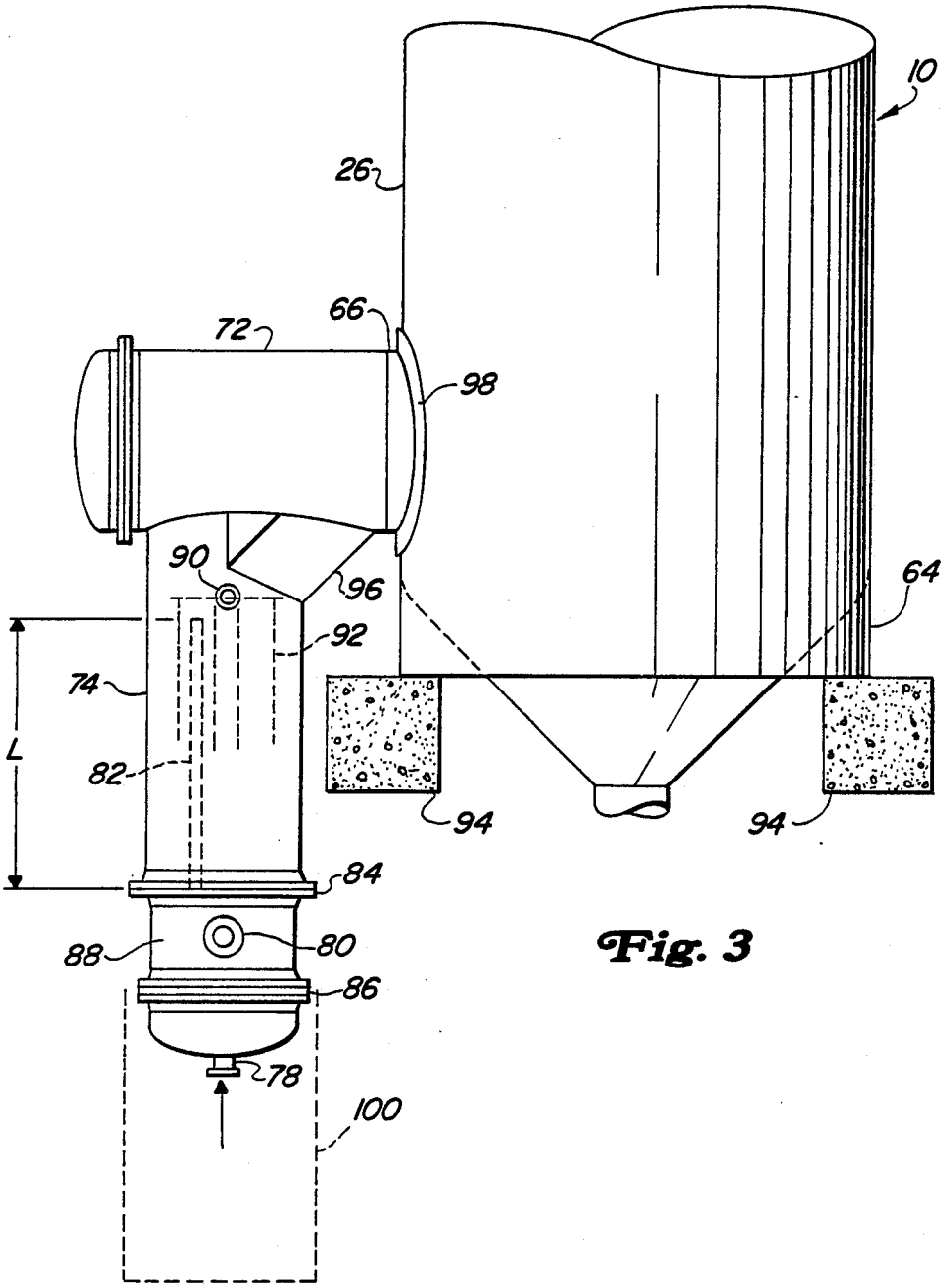
FIG. 3 is an enlarged view of a catalyst cooler shown in FIG. 2.

Additional details of the catalyst cooler arrangement and installation of FIG. 2 are shown in FIG. 3. The cooler shown in FIG. 3 is a backmix type cooler. Tube section 74 of the cooler houses a heat exchanger having catalyst on its shell side and a heat exchange medium, supplied by line 78 and 80, on the tube side of a tube bundle 82. The preferred heat exchange medium would be water which, in further preference, would change only partially from liquid to gas phase when passing through the tubes. It is also preferable to operate the heat exchanger so that the exchange medium is circulated through the tubes at a constant rate. The tube bundle is made up of bayonette type tubes wherein a sealed outer tube having an unattached top end and a bottom end fixed to a tube sheet 84 covers an internal tube that extends from just below the top of the bayonette tube to a lower tube sheet 86. The heat exchange fluid travels up the internal tubes and downwardly between the inner tube and the outer tube where it is collected in a chamber 88 located between upper tube sheet 84 and lower tube sheet 86. Fluidizing gas, preferably air, enters an aeration inlet 90 and is distributed between the tubes by distributor 92.

Locating the tops of the tubes 82 below the interior of the nozzle extension provides the advantage of open access to the regenerator with the necessity of removing the tube bundle. Therefore, nozzle extension 72 may be used for access by merely covering the cooler opening with suitable planking. The large open area of the accessway also facilitates inspection and maintenance on the tube bundle.

The lower portion of tube section 74 is cylindrical in shape. However, where the tube section attaches to the lower side of the nozzle extension 72, cooler is enlarged so that its width in a direction parallel to principal direction of the nozzle is larger than the diameter of the cylindrical portion. The upper portion of the tube section is enlarged in this way to minimize the horizontal distance across the nozzle so that circulation of catalyst between the regenerator and the cooler is enhanced. When using a backmix type cooler in this invention, it is preferred to minimize the distance between the centerline of the cooler and the centerline of the cooler tube section and the centerline of the regenerator vessel. However, the spacing may be limited by support members such as main support beams 94 which support the regenerator vessel 10 through the support skirt 64. Therefore, by providing an angled section 96 at the upper end of tube section 74, catalyst circulation is improved by reducing the horizontal length between the regenerator and cooler at the bottom of the nozzle extension 72.

The angled section 96 provides the cooler with a cylindrically shaped lower section and an enlarged upper end having a width in a direction parallel to the principal direction of the nozzle that exceeds the diameter of the cylindrical portion of the cooler.

FIG. 3 also shows a reinforcing pad 98 that encircles cooler nozzle 66. Typically, the reinforcement provided by pad 98 is calculated to withstand additional stresses in the area of shell 26 adjacent to nozzle opening 66. Pressure loading inside regenerator vessel 10 produces locally higher stresses in the area of the shell that surrounds the opening for nozzle 66. Reinforcement pad 98 provides additional metal to withstand these stresses. In most cases, the reinforcement provided around nozzle 66 is only sufficient to withstand additional pressure stresses and not the additional stresses imposed by external loads such as the catalyst cooler loading. Therefore, in order to avoid adding additional reinforcement to the shell of the regenerator, the weight of the catalyst cooler is carried by suitable counterbalance system so that the addition of the cooler does not impose any additional stresses onto the shell 26.

Figure 4:
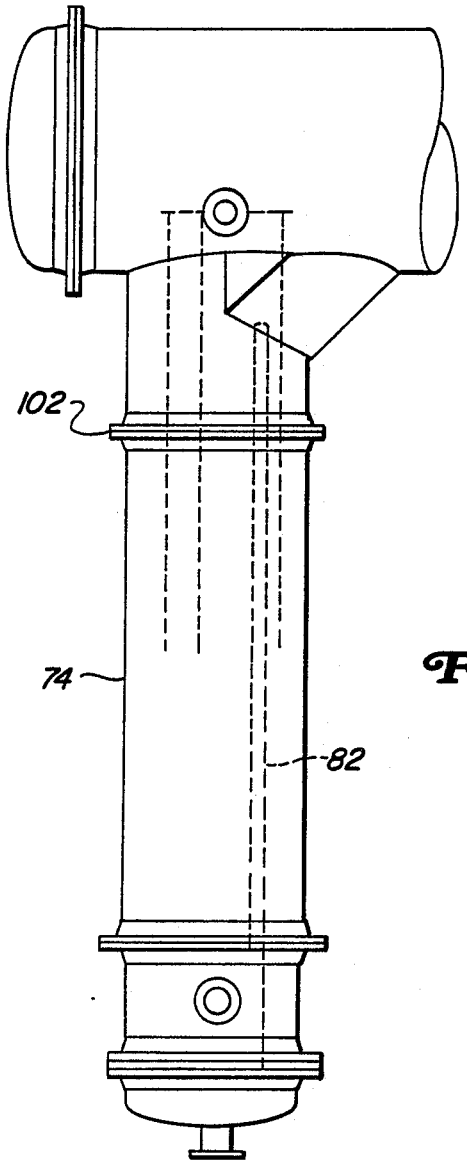
FIG. 4 is a modified catalyst cooler similar to the catalyst cooler shown in FIG. 3.

Normal maintenance on the catalyst cooler requires periodic removal of the tube bundle 82 from the shell section 74 of the catalyst cooler. Unless there is sufficient ground clearance, as indicated by dashed line 100, the tube bundle cannot be removed. The amount of clearance needed equals the length L of the bayonette tubes and tube sheet. If the clearance needed to withdraw the tubes is not available, a pair of flanges 102, as shown in FIG. 4, may be located on an upper portion of tube section 74 so that a portion of the shell associated with tube section 74 may also be removed with the tube bundle. The incorporation of flanges into a configuration of cooler as shown in FIG. 4, can be used to extend the length of tubes 82 where ground clearance is inadequate.

The principals of this invention can also be used to extend the tubes 82 into the cooler nozzle or even above the cooler nozzle. Therefore, it is not necessary that the entire heat exchange surface presented by the tubes lie below the cooler nozzle. A possible variation in this invention would include extending the heat exchange tubes into the cooler nozzle. Another variation could include providing an upper heat exchange section above the cooler nozzle and extending the cooler tubes into a vertical section above the cooler nozzle. It is also not necessary to the practice of this invention that the cooler tubes are inserted from the bottom of tube section 74. It is also possible to extend the heat transfer tubes 82 down from the top and through the cooler nozzle into a lower tube section. Those skilled in the art will be aware of many other cooler designs that can be adapted to use the apparatus and method of this invention.

What is claimed is:

1. An apparatus for regenerating coke-contaminated fluidized catalyst particles said apparatus comprising:

(a) a regenerator vessel for maintaining a relatively dense fluidized bed of catalyst particles;

(b) a substantially horizontal nozzle having a location coinciding with the location of an existing manway opening and projecting away from and in open communication with said regenerator vessel;

(c) a substantially vertical catalyst cooler depending from a horizontal section of said nozzle and in open communication with said nozzle;

(d) a plurality of heat exchange tubes located in said cooler and extending along the principal axis of said cooler; and (e) a removable closure at the end of said nozzle opposite said regenerator vessel.

2. The apparatus of claim 1 wherein said closure includes an end cover and a pair of flanges for removal and installation of said end cover.

3. The apparatus of claim 1 wherein said cooler only communicates with said regenerator through said nozzle.

4. The apparatus of claim 1 wherein the upper end of said cooler is attached to the underside of said nozzle.

5. The apparatus of claim 4 wherein said cooler has a cylindrically shaped lower portion and said upper end of said cooler is enlarged so that its width in a direction parallel to the principal direction of nozzle exceeds the diameter of said cylindrical portion.

6. An apparatus for regenerating coke-contaminated fluidized catalyst cracking particles comprising:

(a) a regenerator vessel having an outer shell for maintaining a relatively dense fluidized bed of catalyst particles, said vessel having a vertical principal axis;

(b) a nozzle in communication with said regenerator vessel and extending horizontally outward from the cylindrical portion of the shell of said regenerator vessel;

(c) a vertically oriented catalyst cooler having an upper end attached to and in open communication with the lower side of said nozzle;

(d) a plurality of vertical heat exchange tubes extending upwardly from a lower end of said catalyst cooler and terminating below the interior of said nozzle; and (e) a closure at the end of said nozzle located opposite said regenerator vessel, said closure including an end cover and a pair of flanges for removing and installing said end cover.

7. The apparatus of claim 6 wherein only said upper end of said catalyst cooler communicates with said regenerator vessel through said nozzle.

8. The apparatus of claim 7 wherein said upper end of said cooler is enlarged in a direction parallel to the principal axis of said nozzle.

9. The apparatus of claim 7 wherein said catalyst cooler has two cooler shell sections, said cooler shell sections are connected by a pair of flanges, and said flanges are located above the lowermost end of said heat exchanger tubes.

10. A method of retrofitting a catalyst cooler on a regenerator vessel of the type used to regenerate coke-contaminated fluidized catalyst cracking particles where said vessel has a nozzle forming an access opening for use when the vessel is not in operation, said nozzle having an end cover occluding said opening, said method comprising;

(a) removing said end cover from said nozzle;

(b) extending said nozzle outwardly from the principal axis of said regenerator vessel with a nozzle extension;

(c) attaching a catalyst cooler to said nozzle extension and openly communicating said cooler with said nozzle extension, said catalyst cooler having a principally vertical orientation and a plurality of heat exchange tubes positioned in said cooler;

(d) providing an end closure on the outermost portion of said nozzle extension.

11. The method of claim 10 wherein said nozzle is extended in the horizontal direction;

12. The method of claim 10 wherein said end cover is flanged to said nozzle, said end cover and flanges are removed from said nozzle, said nozzle extension is welded to said nozzle and said flanges are attached to the end of said nozzle extension to provide said end closure.

* * * * *